United States Patent [19]

Moore

[11] Patent Number: 4,705,314

[45] Date of Patent: Nov. 10, 1987

[54] TOOL LOADING DEVICE

[75] Inventor: John Moore, Aberdeen, Scotland

[73] Assignee: The British Petroleum Company p.l.c., London, England

[21] Appl. No.: 848,127

[22] Filed: Apr. 4, 1986

[30] Foreign Application Priority Data

Apr. 12, 1985 [GB] United Kingdom ..... 8509437

[51] Int. Cl.[4] ..... B63C 11/52; B66C 1/06

[52] U.S. Cl. ..... 294/115; 294/88; 294/86.15

[58] Field of Search ..... 294/115, 86.12, 86.15, 294/86.14, 86.16, 86.26, 86.33, 88

[56] References Cited

U.S. PATENT DOCUMENTS 3,799,602 3/1974 Laws et al. ..... 294/88

4,443,130 4/1984 Hall ..... 294/86.15

*Primary Examiner*—James B. Marbert

*Attorney, Agent, or Firm*—Morgan & Finnegan

[57] ABSTRACT

A tool loading device which enables a wireline tool to be presented vertically to a vertical lubricator comprises two sections—a centralizing hub which is connectable to the upper end of a tool entry system and a latch arm section which carries the tool.

The centralizing hub has an entry in its upper surface and a projection and/or recess on its lower surface.

The latch arm section comprises (a) a tube for carrying the tool, (b) latch arm pivot hub slidably mounted on the tube, (c) latch arms pivoted at one end of the latch arm pivot hub and bearing a lug at the other end adapted for engagement with the projection and/or recess on the centralizing hub, (d) latch arm engagement rams pivotably mounted at one end to the latch arm pivot hub and at the other to a pivot point on the latch arm, and (e) vertical alignment rams connecting the latch arm pivot hub to the centralizing hub.

6 Claims, 1 Drawing Figure

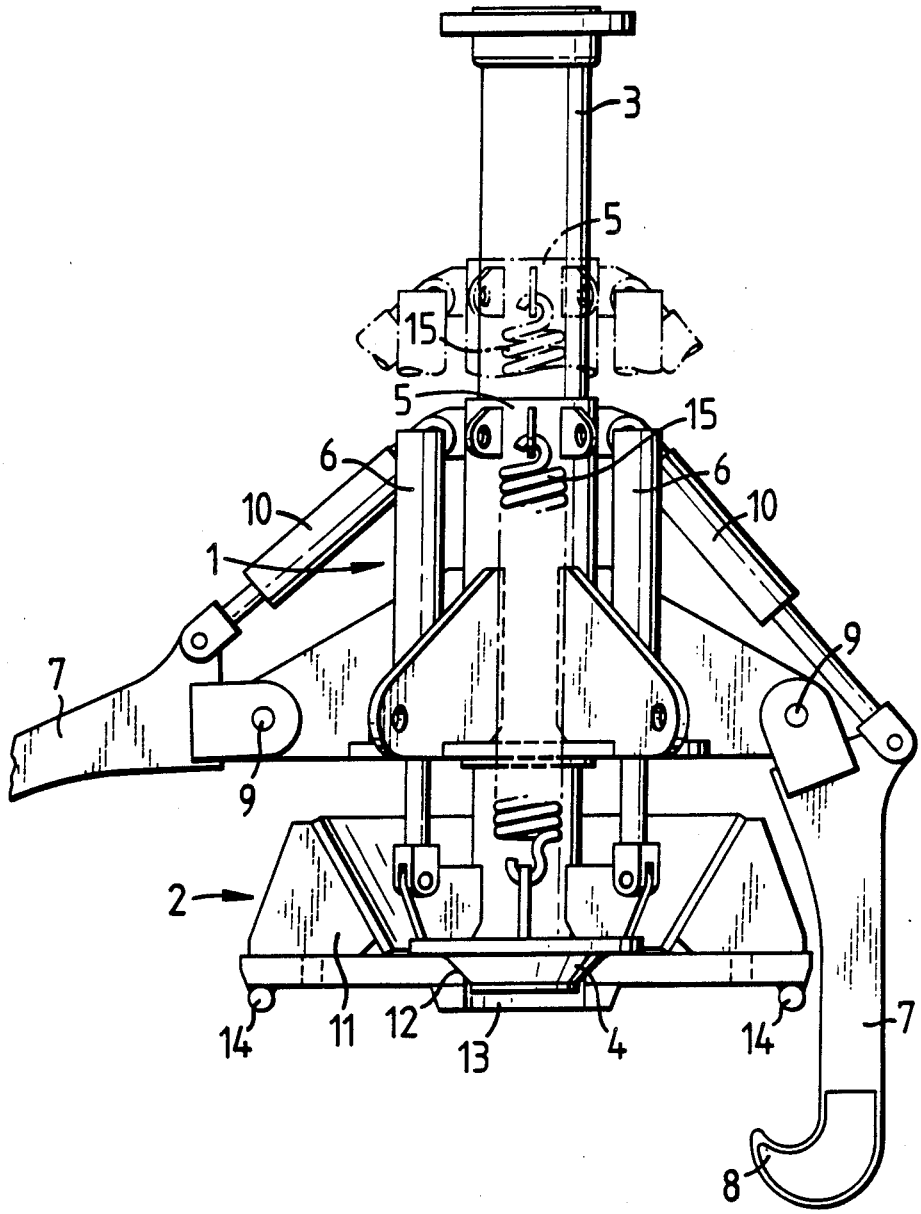
3
5
15
5
15
6
6
10
10
1
9
7
9
2
14
11
12
13
4
14
7
8

TOOL LOADING DEVICE

This invention relates to a tool suitable for loading a subsea wireline lubricator.

During the drilling, testing and operation of an oil well it is sometimes necessary to insert and withdraw instruments such as well logging instruments, to deploy tools, e.g. "fishing" tools, and to replace equipment such as down-hole safety valves, pressure plugs, etc.

These operations are often carried out by the technique known as wirelining in which specially designed equipment is lowered down the well suspended from a solid or braided wire.

Wirelining as such is a reasonably straightforward operation in onshore operations where access to the well is readily available through a conventional "Christmas tree" well head at the earth surface.

Offshore production may be carried out from fixed platforms resting on the sea bed or from semi-submersible or floating platforms or vessels which are capable of some degree of movement.

Fixed platforms generally have several individual well risers rising from the sea bed to well head completion equipment on the platform and are analogous to on-shore locations in that access to the wells for wirelining operations is readily available.

In respect of semi-submersible and floating platforms and vessels, however, wells are generally completed on the sea bed and manifolded to a production riser system, or, in the case of satellite wells, may be remote from the production facility and tied back with flowlines and risers. Thus, immediate access to these wells from the surface is not normally available.

Access can be made available by fitting a tensioned riser back to the surface, but this is difficult, time consuming and expensive and may involve considerable loss of production. One method by which this can be achieved when the well is in close proximity to a movable production platform or vessel is to move the latter so that it is positioned with its moon pool or similar facility positioned directly above the well scheduled for wirelining. Another, which is more suitable for satellite wells, involves the temporary use of a drilling or workover vessel.

Both methods involve the use of a tensioned riser supported from the surface on which conventional surface equipment is mounted.

Our copending European patent application No. 85308088.5 discloses a subsea system which enables access to be gained to subsea wells for wirelining operations without requiring riser access from the surface. This system is hereinafter termed a subsea wireline lubricator and comprises in sequence (a) means for entry, (b) at least one blowout preventor, (c) a riser section, (d) a foot valve and (e) a connector for connection to a subsea well head assembly.

In order to permit a wireline tool to enter a vertically mounted lubricator, the tool itself must be presented to the lubricator in a vertical position. This is sometimes difficult to achieve.

We have now devised a tool loading device which enables this operation to be carried out in a simple and effective manner. The device comprises two sections—a centralising hub which is connectable to the upper end of a tool entry system and a latch arm section which carries the tool.

Thus according to the present invention there is provided a tool loading device comprising (i) a centralising hub, connectable to a tool entry system, the centralising hub having an entry in its upper surface and a projection and/or recess on its lower surface and (ii) a latch arm section, the latch arm section comprising (a) a tube for carrying the tool, (b) a latch arm pivot hub slidably mounted on the tube, (c) latch arms pivoted at one end to the latch arm pivot hub and bearing a lug at the other end adapted for engagement with the projection and/or recess on the centralising hub, (d) latch arm engagement rams pivotably mounted at one end to the latch arm pivot hub and at the other to a pivot point on a latch arm, and (e) vertical alignment rams connecting the latch arm pivot hub to the centralising hub.

Preferably at least three latch arms are provided equiangularly spaced around the latch arm pivot hub.

Preferably at least three vertical alignment rams are provided equiangularly spaced around the latch arm pivot hub and centralising hub.

The entry to the centralising hub is suitably in the form of a recessed cone.

The tube is suitably fitted with a conical centralising hub at its lower end to facilitate location in the recessed entry cone.

The centralising hub and the latch arm section are preferably spring loaded to achieve a fail safe mode of operation with the latch arms disengaged.

Preferably at least three springs are provided equiangularly spaced around the latch arm pivot hub and centralising hub.

In use, regardless of its orientation, the lower end of the tube containing a tool is positioned in the entry cone on the upper surface of the hub. This may be done by using a pre-rigged snatch-block and guide wire. The latch arm engagement rams are then operated to swing the latch arms so that their lugs are located on the projection and/or recess on the lower surface of the hub and latched on to it. The rams between the latch arm pivot hub and the centralising hub are then operated to move the tube into the vertical position. The tool is then lowered from the tube into the entry system of the well.

The invention is illustrated with reference to the accompanying drawing which is an elevation of a loading tool for a subsea well wireline lubricator.

The tool comprises two sections shown generally as 1 and 2. 1 is the latch arm assembly and 2 is the centralising hub.

The assembly 1 comprises a tool carrying tube 3 which has a conical centralising hub 4 at its lower end. The tube also carries a slidably mounted latch arm pivot hub 5 (shown in two operating positions) connected to the centralising hub 2 by three vertical alignment hydraulic rams 6. Six latch arms 7 having lugs 8 are pivoted to the hub 5 at pivot points 9. The position of the arms is controlled by six latch arm engagement hydraulic rams 10. The arm 7 shown in the right hand side of the drawing is in the locking position before contact with the centralising hub 2. The arm 7 shown in the left hand side is in the relaxed position which would be used in deploying the tool before contact with the lubricator and in releasing the tool after completion of operations.

The centralising hub 2 comprises a body 11 having an entry cone 12 on its upper surface, an internal passageway 13 and a ridge 14 on its lower surface to engage with lugs 8 of latch arms 7.

The hub 2 is connected to a stuffing box at the upper end of a subsea wireline lubricator (not shown).

Springs 15 are provided so that in the event of failure of hydraulic power to the rams 6 and 10, the arms 7 retract and the tool is disconnected.

I claim:

1. A tool loading device comprising (i) a centralizing hub, connectable to a tool entry system, the centralizing hub having an entry in its upper surface and a projection and/or recess on its lower suface and (ii) a latch arm section, the latch arm section comprising (a) a tube for carrying the tool, (b) latch arm pivot hub slidably mounted on the tube, (c) latch arms pivoted at one end to the latch arm pivot hub and bearing a lug at the other end adapted for engagement with the projection and/or recess on the cetralizing hub, (d) latch arm engagement rams pivotably mounted at one end to the latch arm pivot hub and at the other to a pivot point on the latch arm, and (e) vertical alignment rams connecting the latch arm pivot hub to the centralizing hub, the centralizing hub and the latch arm section being spring loaded to achieve a fail safe mode of operation with the latch arms disengaged.

2. A tool loading device according to claim 1 wherein at least three latch arms are provided equiangularly spaced around the latch arm pivot hub.

3. A tool loading device according to claim 1 wherein at least three vertical alignment rams are provided equiangularly spaced around the latch arm pivot hub and centralising hub.

4. A tool loading device according to claim 1 wherein the entry to the centralising hub is in the form of a recessed cone.

5. A tool loading device according to claim 4 wherein the tube is fitted with a tapering boss at its lower end to facilitate location in the recessed entry cone.

6. A tool loading device according to claim 1 wherein the centralising hub and the latch arm section are connected by at least three springs equiangularly spaced around the latch arm pivot hub and centralising hub.

* * * * *